US006528958B2

(12) United States Patent
Hulshof et al.

(10) Patent No.: US 6,528,958 B2
(45) Date of Patent: Mar. 4, 2003

(54) DISPLAY DEVICE AND CATHODE RAY TUBE

(75) Inventors: Jozef Johannes Maria Hulshof, Eindhoven (NL); Frederik Christiaan Gehring, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/996,001

(22) Filed: Nov. 16, 2001

(65) Prior Publication Data

US 2002/0060536 A1 May 23, 2002

(30) Foreign Application Priority Data

Nov. 20, 2000 (EP) ..... 00204101

(51) Int. Cl.[7] ..... H01J 29/52
(52) U.S. Cl. ..... 315/380; 315/383; 313/422
(58) Field of Search ..... 315/370, 379, 315/380, 381, 383, 384, 386, 387; 313/422, 425, 461, 463

(56) References Cited

U.S. PATENT DOCUMENTS 5,142,206 A * 8/1992 Gries ..... 315/408
5,270,611 A * 12/1993 Van Gorkom ..... 313/422
5,280,360 A * 1/1994 Derdyra et al. ..... 358/242
5,883,669 A * 3/1999 Hitachiya et al. ..... 348/377
6,046,552 A * 4/2000 Yoon ..... 315/380
6,137,245 A * 10/2000 Hsieh ..... 315/383

* cited by examiner

*Primary Examiner*—Tho Phan

(57) ABSTRACT

The invention relates to a display device comprising a cathode ray tube including an electron source and an electron beam guidance cavity having an entrance aperture and an exit aperture for concentrating electrons emitted from the cathode in an electron beam. Furthermore, the cathode ray tube comprises a first electrode which is connectable to a first power supply for applying, in operation, an electric field with a first field strength E1 between the cathode and the exit aperture. δ1 and E1 have values, which allow electron transport through the electron beam guidance cavity. Furthermore, a modulating means positioned between the cathode and the exit aperture is present for modulating a beam current to the display screen. According to the invention, the display device is provided with switching means for preventing the electron beam from passing through the exit aperture in a blanking period and for passing the electron beam through the exit aperture in a display period.

13 Claims, 4 Drawing Sheets

DISPLAY DEVICE AND CATHODE RAY TUBE

FIELD OF TECHNOLOGY

The invention relates to a display device as defined in the precharacterizing part of claim 1.

The invention also relates to a cathode ray tube which is suitable for use in a display device.

BACKGROUND AND SUMMARY

Such a display device is used in, inter alia, television displays, computer monitors and projection TVs.

A display device of the kind mentioned in the opening paragraph is known from U.S. Pat. No. 5,270,611. U.S. Pat. No. 5,270,611 describes a display device comprising a cathode ray tube which is provided with a cathode, an electron beam guidance cavity and a first electrode which is connectable to a first power supply means for applying the electric field with a first field strength E1 between the cathode and an exit aperture. The electron beam guidance cavity comprises walls in which, for example, a part of the wall near the exit aperture comprises an insulating material having a secondary emission coefficient δ1. Furthermore, the secondary emission coefficient δ1 and the first field strength E1 have values which allow electron transport through the electron beam guidance cavity. The electron transport within the cavity is possible when a sufficiently strong electric field is applied in a longitudinal direction of the electron beam guidance cavity. The value of this field depends on the type of material and on the geometry and sizes of the walls of the cavity. In a steady state, the electron transport takes place via a secondary emission process so that, for each electron impinging on the cavity wall, one electron is emitted on average. The circumstances can be chosen to be such that as many electrons enter the entrance aperture of the electron beam guidance cavity as will leave the exit aperture. When the exit aperture is much smaller then the entrance aperture, an electron compressor is formed which concentrates a luminosity of the electron source with a factor of, for example, 100 to 1000. An electron source with a high current density can thus be made. An accelerating grid accelerates electrons leaving the cavity towards the main electron lens. A main electron lens images the exit aperture of the cavity on the display screen and, via a deflection unit, a raster image is formed on the display screen of the tube.

In a conventional television system it is desirable that the characteristics of the three electron beams for R,G, B are known for performing color point stabilization, black current stabilization and white level stabilization. Therefore, the electron beam current has to be measured at regular intervals at a predetermined drive level during generation of a measurement line in a blanking period. This blanking period is at the beginning of each field. Normally, the image is displayed on the cathode ray tube with some overscan, so that the borders of the image fall outside the visible area of the display screen. However, when an image with a 16:9 aspect ratio is displayed on a display screen with a 4:3 aspect ratio, the measurement line becomes visible. This results in annoying effects on the display screen or the application of adaptations of the vertical deflection to avoid these effects. These annoying effects will also appear in computer monitors, in which the image is displayed with underscan on the cathode ray tube.

It is, inter alia, an object of the invention to provide a cathode ray tube in which the beam current can be measured without visible effects on the display screen. This object is achieved by the cathode ray tube according to the invention, which is defined in claim 1. When the display device in accordance with the invention is in operation, in the blanking period, the switching means are arranged in such a way that the current from the cathode remains uninterrupted, whereas the electron beam is deflected and cannot reach the exit aperture of the electron beam guidance cavity. Therefore, for example, the modulating voltage versus beam current characteristics of the cathode ray tube can be measured during the blanking period without visible artefacts, whereas the beam current is uninterrupted in the display period.

A further advantage is that, with the measured beam current, further operations might be possible such as beam current limitation in order to protect overload of a high tension power supply or geometrical compensation of the image for varying loads of the extremely high tension power supply. Further advantageous embodiments are defined in the dependent claims.

A particular embodiment of the display device according to the invention is defined in claim 2. In this embodiment, the electron beam is deflected between the third electrode and the exit aperture of the electron beam guidance cavity in dependence upon an applied voltage difference between the first and the third electrode.

A further embodiment of the display device according to the invention is defined in claim 3. The addition of the fourth electrode allows a quick start-up of the electron transport mechanism of the electron beam in the electron beam guidance cavity to the display screen with respect to the embodiment comprising only a third electrode, because no negative charge is accumulated on the insulating wall near the exit aperture in the embodiment with the third and fourth electrode when the beam current is prevented from passing through the exit aperture. In this embodiment, a transport voltage on the first electrode is maintained at a constant level.

A further embodiment of the display device according to the invention is defined in claim 5. With the first range of the modulating voltages, a diode characteristic of the cathode ray tube is obtained for a predetermined set of dimensions and shapes of the second electrode and the third electrode, the distance between the cathode and the second electrode, and the distance between the second electrode and the third electrode, respectively. An advantage of this embodiment is that the modulating voltage at the cathode may be in the range between 0 and 10 V so that low voltage electronics can be applied. However, the gamma of the cathode current versus modulating voltage is limited to about 1.8 in this embodiment.

A further embodiment of the display device according to the invention is defined in claim 7. For this second range of the modulating voltages, a triode characteristic of the cathode ray tube is obtained for a predetermined set of dimensions and shapes of the second electrode and the third electrode, the distance between the cathode and the second electrode, and the distance between the second electrode and the third electrode, respectively. An advantage of the triode characteristic is that the gamma of the cathode current versus modulating voltage resembles that of a conventional cathode ray tube so that the cathode ray tube with the electron guidance cavity is more compatible with the conventional cathode ray tube. The gamma is, for example, about 2.4.

A further embodiment of the display device according to the invention is defined in claim 9. A funnel-shaped exit aperture allows hop entrance of electrons with a small electric force in the tangential direction with respect to the exit aperture. In this embodiment, the average energy of the electrons is hardly increased and the spread of energy distribution will also hardly increase, while the spot size on the display screen can be reduced.

BRIEF DESCRIPTION OF THE DRAWINGS

These and other aspects of the invention are apparent from and will be elucidated with reference to the embodiments described hereinafter. In the drawings.

DETAILED DESCRIPTION

Figure 1:
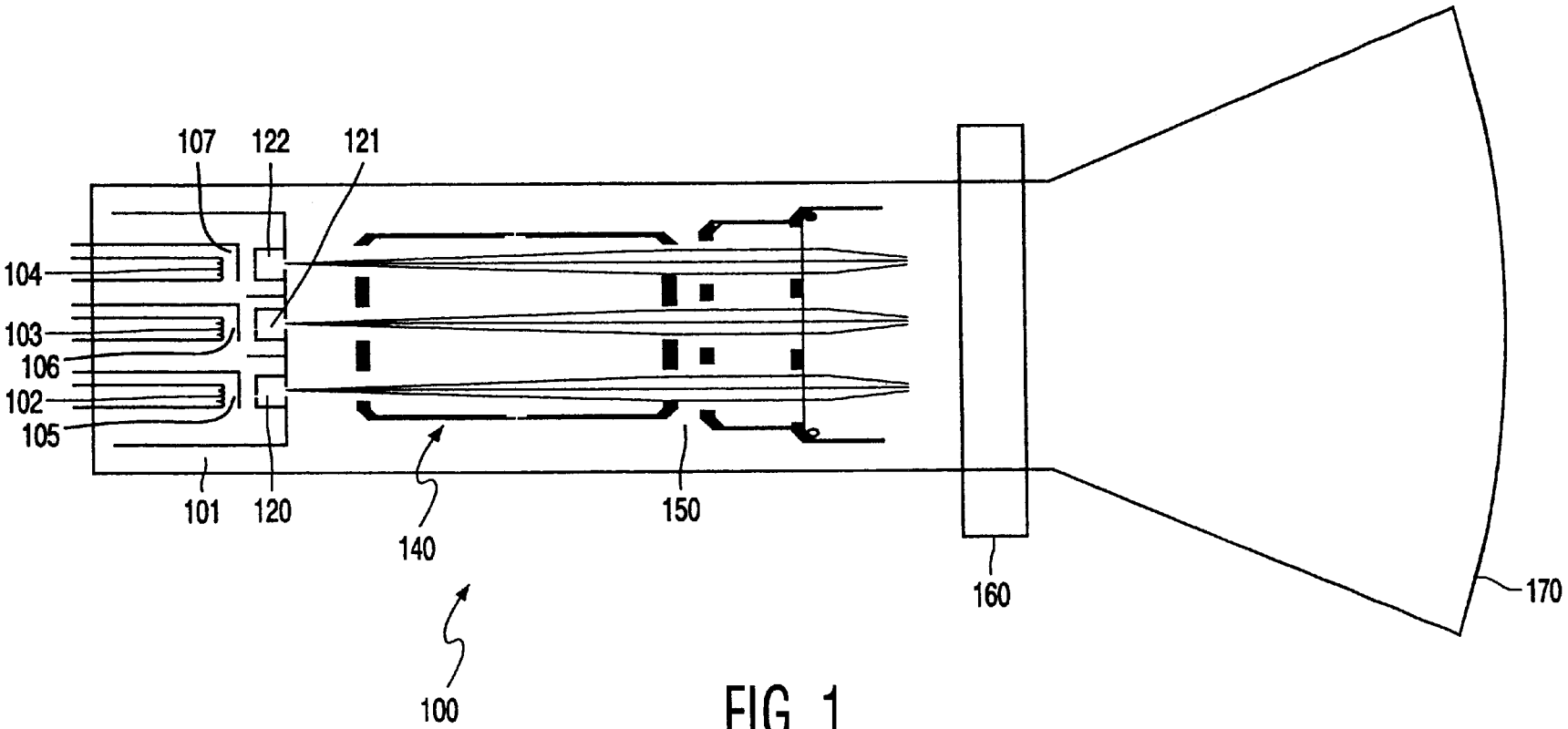
FIG. 1 PRIOR ART
FIG. 1 is a schematic diagram of a display device comprising a cathode ray tube.

The display device comprises a cathode ray tube. FIG. 1 is a schematic diagram of a known cathode ray tube. This cathode ray tube is known per se from the cited U.S. Pat. No. 5,270,611. The cathode ray tube 100 comprises an electrode structure 101 having cathodes 105,106,107 for emission of electrons and electron beam guidance cavities 120,121,122. Preferably, the cathode ray tube comprises heating filaments 102,103,104. Furthermore, the cathode ray tube comprises an accelerating grid 140, a conventional main lens 150, a conventional magnetic deflection unit 160 and a conventional color screen 170. All of these parts are known from conventional color cathode ray tubes. The cathode ray tube according to the invention may be used in television, projection television and computer monitors.

Figure 2:
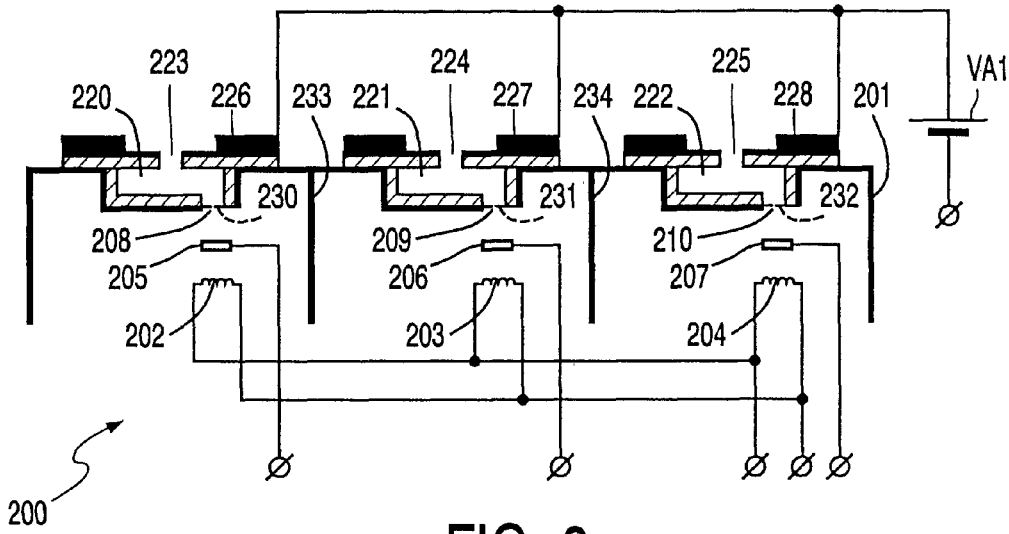
FIG. 2 shows a cathode structure with the electron beam guidance cavity for use in a cathode ray tube.

FIG. 2 shows a first embodiment of the cathode structure in accordance with the invention, which cathode structure may be used in the cathode ray tube shown in FIG. 1. The cathode structure 200 comprises a frame 201, heating filaments 202, 203, 204 and cathodes 205,206,207 corresponding to each heating filament. The cathodes are provided in triplicate so that the cathode ray tube may be used for displaying of color images represented by red, green and blue signals. Furthermore, the cathode structure 200 comprises electron beam guidance cavities 220,221,222 each having an entrance aperture 208,209,210, an exit aperture 223,224,225 and a first electrode 226,227,228. The entrance apertures 208,209,210 may have a square shape with dimensions of 2.5×2.5 mm. At least a part of the interior around the exit apertures 223,224,225 of the electron beam guidance cavities 220,221,222 is covered with an insulating material having a secondary emission coefficient $\delta 1>1$ for cooperation with the cathodes 205,206,207. This material comprises, for example, MgO. The MgO layer has a thickness of, for example, 0.5 micrometer. Other materials that may be used are, for example, glass or Kapton polyamide material. The first electrodes 226,227,228 are positioned around the exit apertures 223,224,225 on the outer side of the electron beam guidance cavities 220,221,222. The first electrodes consist of a metal sheet. The metal sheet has a thickness of, for example, 2.5 micrometers and can be applied by metal evaporation of, for example combination of aluminum and chromium. The exit apertures 223,224,225 may have a circular shape with a diameter of, for example, 20 micrometers. Furthermore, each filament 202,203,204 for heating the cathodes 205,206,207 can be coupled to a first power supply means V1 (not shown). In operation, each filament 202,203,204 heats up a corresponding cathode 205,206,207. The cathode comprises conventional oxide cathode material, for example, barium oxide. In operation, the first electrode 226,227,228 is coupled to a second power supply means VA for applying an electric field with a field strength E1 between the cathode 205,206,207 and the exit aperture 223,224,225. The voltage of the second power supply means is, for example, in the range between 100 and 1500 V, typically 700 V. The secondary emission coefficient $\delta$ and the field strength have values which allow electron transport through the electron beam guidance cavity. This kind of electron transport is known per se from the cited U.S. Pat. No. 5,270,611.

Preferably, a modulating means, for example, a second electrode 230,231,232 is placed before the entrance aperture 208,209,210. The second electrode 230,231,232 is coupled to a third power supply means VE (not shown) for applying, in operation, an electric field with a second field strength E2 between the cathode 205,206,207 and the second electrode 230,231,232 for controlling the emission of electrons. Preferably, the second electrode 230,231,232 comprises a gauze with a 60% transmission of electrons. The gauze may be made of a metal, for example, molybdenum, and may be electrically coupled to the frame 201. In practice all of, the three gauzes 230,231,232 are electrically coupled to the frame 201. A voltage difference between the cathodes 205, 206,207 and the gauzes 230,231,232 is determined by applying a fixed voltage to the frame and varying voltages to the gauzes. In operation, a pulling field due to the voltage difference applied between the gauzes 230,231,232 and the cathodes 205,206,207 pulls the electrons away from the cathodes 205,206,207. The voltage differences between the cathodes 205,206,207 and corresponding gauzes 230,231, 232 corresponds to respective R,G,B signals which represent the image. For a further explanation of the operation of the cathode ray tube, reference is made to FIG. 1. After the electrons have left the exit aperture 223,224,225 of the electron beam guidance cavity 220,221,222, the accelerating gauze 140 accelerates the emitted electrons into the main lens 150. Via the main lens 150 and the deflection unit 160, the three electrode beams corresponding to the red, green and blue signals are directed to the color screen 170 in order to build the image represented by the red, green and blue signals. Now, reference will be made to the cathode structure of FIG. 2. When the distance between the gauzes 230,231, 232 and the cathodes 205,206,207 is small enough, for example, in a range between 20 and 400 micrometers, a relatively low voltage difference between the cathodes 205, 206,207 and the gauzes 230,231,232 can modulate the emission of the electrons towards the entrance aperture of the electron beam guidance cavities 220,221,222. For example, when a distance between the cathodes 205,206,207 and the gauzes 230,231,232 is 100 micrometers, a voltage swing of 5 volts can modulate an electron beam current of between 0 and 3 mA to the electron beam guidance cavities 220,221,222.

In conventional television sets, the electron beam current is measured during a measurement line at the beginning of each field. During this measurement, the beam current is measured at, for example, two different levels of the modulating voltage on the cathode. In conventional television sets, this measurement line will be visible when a TV picture with a 16:9 aspect ratio is displayed on a TV with a CRT having a 4:3 aspect ratio. This measurement line will also be visible in a computer monitor, in which the image is displayed with underscan on the screen of the cathode ray tube. In order to measure the beam current of the cathode ray tube, the electron beam guidance cavity is provided with switching means for preventing, in a blanking period, the electron beams from passing through the exit apertures.

Figure 3:
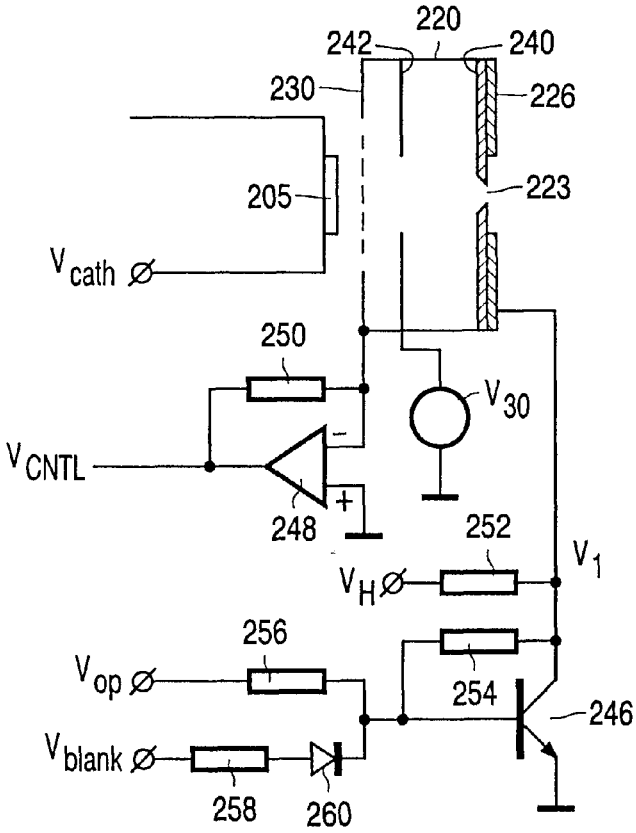
FIG. 3 shows an operating circuit and a cathode structure with one electrode within an electron beam guidance cavity for operation in a diode characteristic.

FIG. 3 shows an example of an operating circuit and a cathode structure with a switching means comprising one electrode within an electron beam guidance cavity for operation in a diode mode. This cathode structure is applied in triplicate in the cathode ray tube as is described with reference to FIG. 1 and FIG. 2. The cathode structure comprises a conventional cathode 205, a modulation gauze 230 acting on a second electrode 230 and the electron beam guidance cavity 220 with a wall 240 comprising insulating material for example, MgO. The wall 240 around the exit aperture 223 has a thickness of 100 micrometers. To improve the spot size on the display screen, the exit aperture 223 preferably has a funnel shape. In this example for television applications, the exit aperture 223 at the outer side of the electron beam guidance cavity has a diameter of 20 micrometers. For monitor applications, which demand a smaller spot size on the color screen 170, the exit aperture 223 at the outside of the cavity may have a diameter of 10 micrometers. A first electrode 226 comprising an aluminum sheet 226 with a thickness of 1 micrometer is provided around the exit aperture 223 of the electron beam guidance cavity. Other metals can be used instead of aluminum. In order to use low-voltage driving electronics, the modulating voltage of the second electrode 230 or the cathode 205 has a value in a first range between 0 and 10 V. This first range imposes a diode characteristic on the modulating voltage versus beam current characteristic of the electron beam guidance cavity.

In this example, the switching means comprises the third electrode 242 arranged between the second electrode 230 and the first electrode 226, this third electrode 242 being connected to a third power supply means V30. Furthermore, the first electrode 226 is connected to a switchable voltage source V1. The third power supply V3 supplies a third voltage V3 of about 800 V to the third electrode 242.

In a blanking period, the voltages on the first and third electrodes 226,230 have respective first and second values for preventing the electrons from passing through the exit aperture and having respective third and fourth values for passing the electron beam to the display screen 170 during a display period. In a display period, the switchable first power supply V1 has a voltage of 1000 V and in a blanking period, the voltage supplied to the first electrode 226 is 0 V so that, in a blanking period, the electron beam current to the color screen 170 is stopped. The switchable first voltage source V1 is formed by a circuit comprising a first transistor 246, four resistors 252,254,256,258 and a diode 260. The collector of the first transistor 246 is coupled to the first electrode 226 to a positive pole of the power supply Vh via the first resistor 252 and to the base of the first transistor 246 via a second resistor 254. A signal Vop is coupled to the base of transistor 246 via the third resistor 256 and a signal Vblank is coupled to the base of the first transistor 246 via a series connection of the fourth resistor 258 and diode 260. The emitter of the first transistor 246 is connected to ground. In a display period, when the signal Vblank is zero, the voltage Vop is determined by the voltage Vh and the first, second and third resistors 252,254,256 and the voltage Vbe between the base and the emitter of the first transistor 246. During a blanking period, the signal Vblank becomes high, for example 5V. Now the values of first, second and fourth resistors 252,254,258 are dimensioned to set the voltage V1 at a low voltage, for example 5V, so as to stop the electron transporting mechanism in the electron beam guidance cavity. As a result, the electron beam does not reach the exit aperture 223 of the electron beam guidance cavity. A disturbing measurement line will therefore not be visible on the color screen 170 during the blanking period. During the blanking period, the voltage difference between the cathode 205 and the second electrode 230 will be adjusted to different levels so as to measure one or several points of the modulating voltage versus beam current characteristic. This procedure is repeated for the cathode and electron beam guidance cavities associated with the other ones of the three colors R,G,B.

In the diode mode, the current through the second electrode 230 can be measured by a first measurement means comprising, for example, an operational amplifier 248 and a fifth resistor 250. The second electrode 230 is connected to the negative input of the operational amplifier 248.The positive input is connected to ground, the fifth resistor 250 is connected between the negative input and the output of the operational amplifier 248. In operation, the operational amplifier 248 acts as a current-voltage converter and converts the current Ig2 through the second electrode 230 into a control voltage Vcnt1. Vcnt1 corresponds to the beam current, because Ig2 is proportional to the beam current. Alternatively, the measurement means may comprise a resistor. The resistor may be connected between the second electrode and ground for measuring a current which is proportional to the beam current (not shown).

In order to improve the start-up of the beam current in the display period, the switching means may comprise a third and a fourth electrode.

Figure 4:
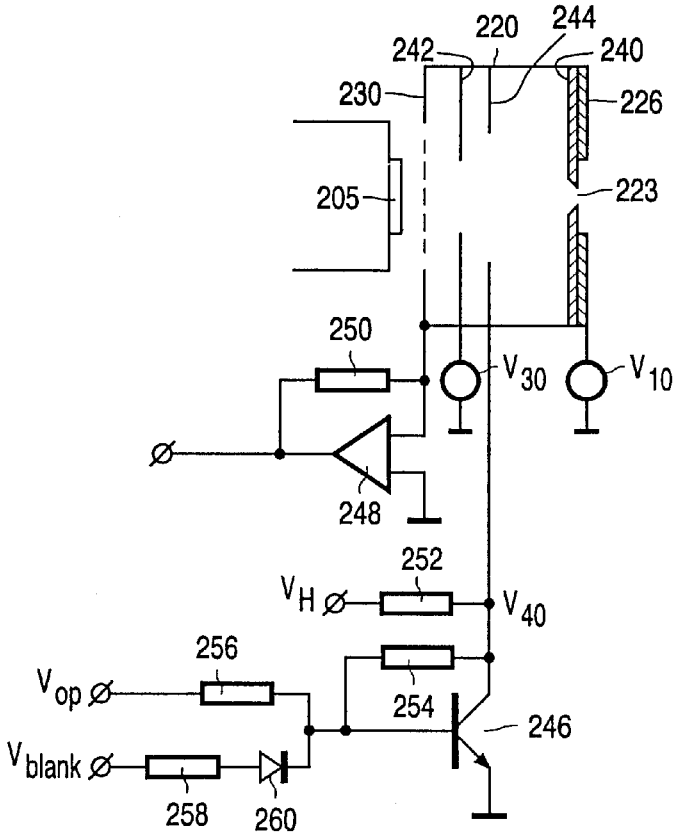
FIG. 4 shows an operating circuit and a cathode structure with two electrodes within an electron beam guidance cavity for operation in a diode characteristic.

FIG. 4 shows an example of an operating circuit and a cathode structure having switching means comprising a third and a fourth electrode 242,244 within the electron beam guidance cavity for operation in a diode mode. The construction of the cathode structure is analogous to the cathode structure described with reference to FIG. 3, with the exception that a fourth electrode 244 is positioned between the first and the third electrode 226,242. The third electrode 242 is provided with a first aperture having a first diameter. The fourth electrode 244 is provided with a second aperture having a second diameter, which is larger than the first diameter of the first aperture. In operation, the first electrode 226 is connected to a first power supply with a voltage V10 of, for example, 800V. The third electrode 242 is connected to a third power supply V30 with a voltage of 400 V. The fourth electrode 244 is connected to a switchable fourth power supply V40. The switchable fourth power supply V40 is arranged to supply a voltage of 300 V to the fourth electrode 244 in a display period and a voltage of 1000V to the fourth electrode 244 in a blanking period. In the blanking period, the fourth electrode 244 drains the electrons and the electrons will not reach the exit aperture 223 of the electron beam guidance cavity. Alternatively, the switchable fourth power supply V40 may supply a voltage of 300 V in a display period to the fourth electrode 244 and in a blanking period a voltage of 0 V. In the latter case, the third electrode 242 drains the electrons and the electrons will not reach the exit aperture 223 of the electron beam guidance cavity. The switchable fourth power supply V40 is formed by a circuit comprising a first transistor 246, four resistors 252,254,256, 258 and a diode 260. The operation of the switchable fourth power supply V40 is analogous to the switchable first power supply V1 explained with reference to FIG. 3. The current through the second electrode 230 can be measured by a first measurement means comprising, for example, the operational amplifier 248 and a fifth resistor 250 as described with reference to FIG. 3. During a display period, the voltages V10 and V40 on the respective first, fourth electrodes 226, 244 are such that the electron beam moves through the electron beam guidance cavity to the exit aperture 223, and the voltages V10 and V40 in a blanking period are such that the electron beam does not reach the exit aperture 223. When the voltage difference between the cathode 205 and the second electrode 230 has a value in the range between 10 and 30 V, a triode characteristic of the modulating voltage beam current is imposed on the modulating voltage beam current characteristics of the electron beam guidance cavity. In this range, the modulating voltage beam current characteristics will resemble those of the conventional cathode ray tube. The gamma of a cathode ray tube comprising this cathode structure will be about 2.4. This allows a better compatibility with conventional cathode ray tubes. Furthermore, since no current is drained by the second electrode 230 in the triode mode, a current measurement means is included in the cathode circuit.

Figure 5:
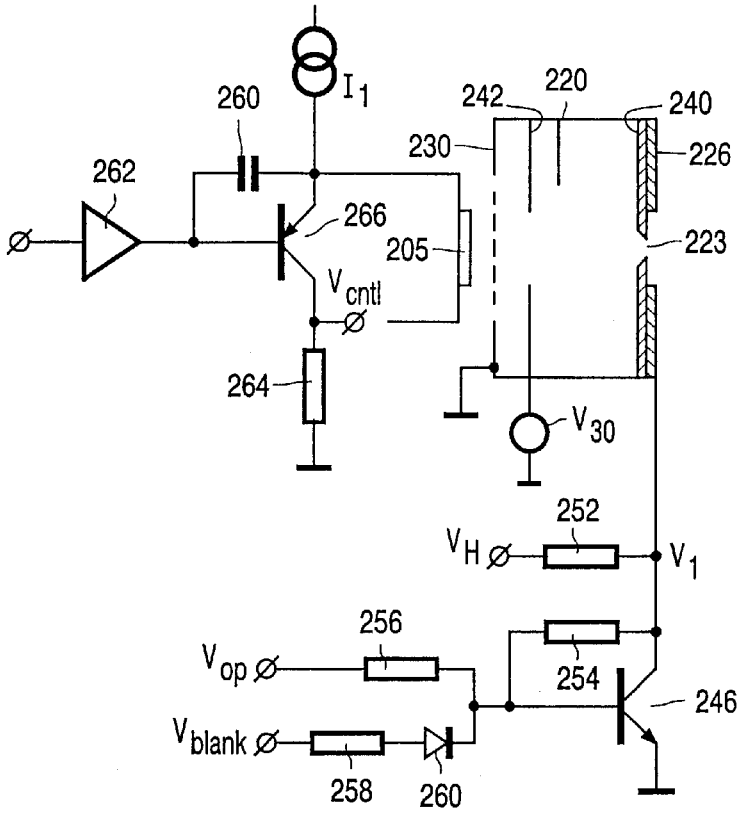
FIG. 5 shows an operating circuit and a cathode structure with one electrode within an electron beam guidance cavity for operation in a triode characteristic.

FIG. 5 shows an example of an operating circuit and a cathode structure having switching means comprising the third electrode 242 within the electron beam guidance cavity for operation in a triode characteristic. Basically, the circuit is analogous to that described with reference to FIG. 3 The second measurement means are formed by a current source I1, an amplifying element, for example, a second transistor 266 and a sixth resistor 264. The cathode 205 is connected to the emitter of the second transistor 266 and to a node of the current source I1. The emitter of the second transistor 266 is coupled to the output of a video amplifier 262 via a capacitor 260. The collector of the second transistor 266 is coupled to ground via the sixth resistor 264. The voltage Vcntl on the collector of the second transistor 266 is indicative of the beam current. Furthermore, the first electrode 226 is connected to a switchable first power supply V1 and the third electrode 242 is positioned between the first and the second electrodes 226,230. The third electrode 242 is connected to a third power supply V3 having a third voltage of about 800 V. The switchable first power supply V1 is of the same type as described with reference to FIG. 3. When operating in a display period, the switchable first power supply V1 has a voltage of 1000 V and, in a blanking period, the switchable power supply has a voltage of 0 V, so that, in a blanking period, the electron beam to the display screen is stopped.

Figure 6:
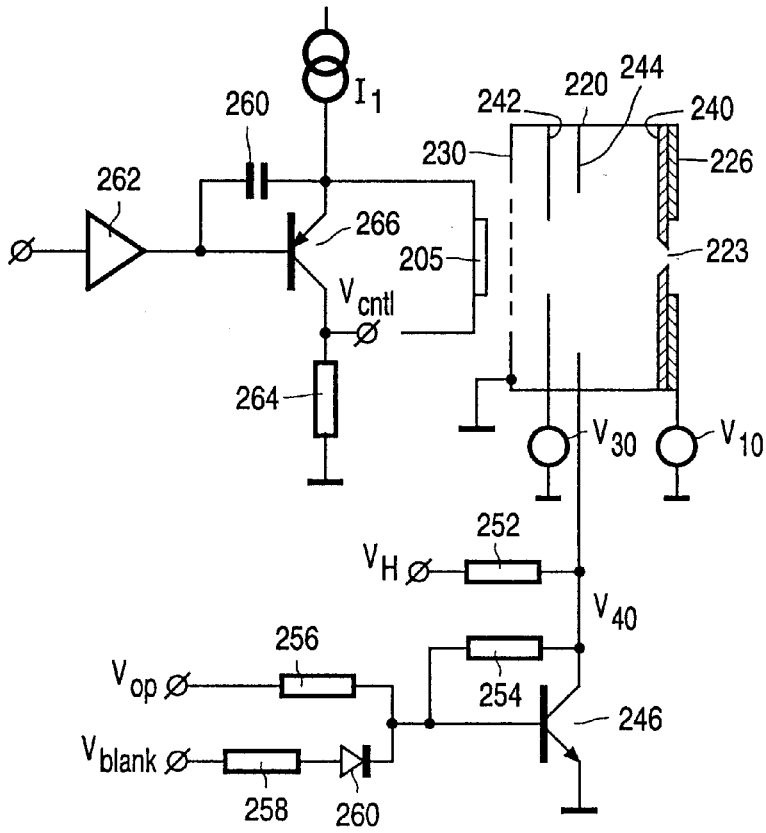
FIG. 6 shows an operating circuit and a cathode structure with two electrodes within an electron beam guidance cavity for operation in a triode characteristic.

FIG. 6 shows an example of an operating circuit and a cathode structure having switching means comprising a third and a fourth electrode 242,244 within the electron beam guidance cavity 220 for operation in a triode characteristic. Basically, the construction is analogous to that described with reference to FIG. 4. An advantage of this example is the improved start up of the electron beam in the display period. In this example, the second current measurement means are included in the cathode connections. The first electrode 226 is connected to a power supply V10 with a voltage V1 of, for example, 800V. The modulating voltage between the cathode 205 and the second electrode 230 is in the range between 10 and 30 volts. The third electrode 242 is connected to a third power supply V30 with a voltage of 400. The fourth electrode 244 is connected to a switchable fourth power supply V40 supplying a voltage of 300 V in a display period to the fourth electrode 244 and a voltage of 1000 V in a blanking period. In this blanking period, the fourth electrode 244 drains the electrons and the electrons will not reach the exit aperture 223 of the electron beam guidance cavity. Alternatively, the switchable fourth power supply V40 may supply a voltage of 300 V in a display period to the fourth electrode 244 and a voltage of 0 V in a blanking period. In the blanking period, the electrons will be drained by the third electrode 242 and will not reach the exit aperture 223 of the electron beam guidance cavity. The second current measurement means are of the same type as described with reference to FIG. 5.

Figure 7:
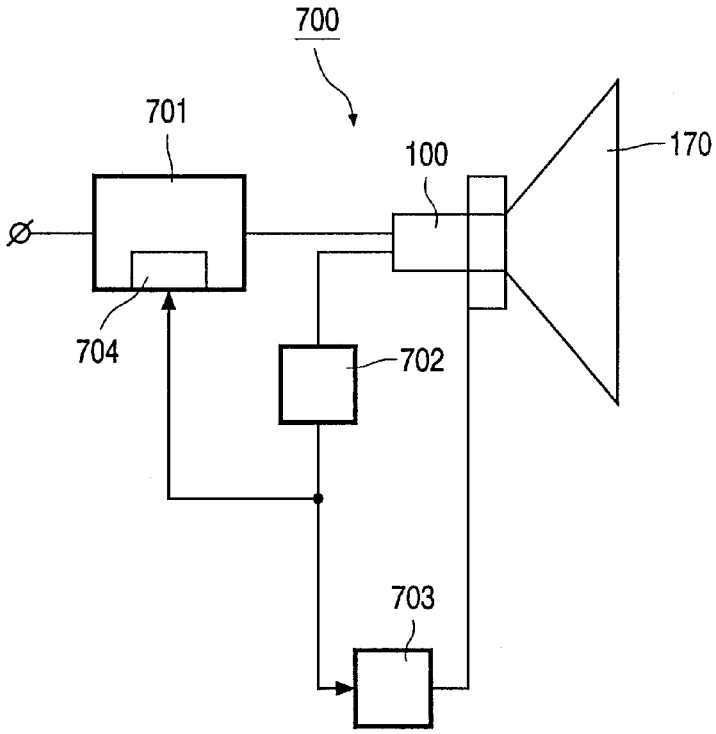
FIG. 7 shows a display system comprising a color cathode ray tube with the electron beam guidance cavity cathode structure.

FIG. 7 shows a display system 700 comprising a color cathode ray tube with the electron beam guidance cavity cathode structure. The display system 700 comprises a video-processing circuit 701 for beam current stabilization. The beam current stabilization may comprise a black current stabilization circuit, a color point stabilization circuit and a white level stabilization circuit. These circuits are well known to a person skilled in the art. Furthermore, the display system 700 may comprise a geometrical compensation circuit 703 and/or a beam current limiter circuit 704. The geometrical compensation circuit 703 will adjust the deflection of the beam in dependence upon a voltage change in the extremely high voltage power supply CRT due to a variable loading by the beam current. The beam current limiter circuit 704 will reduce the beam current if the average beam current is higher than a predetermined level during a predetermined period. The beam current limiter circuit 704 may be comprised in the video-processing circuit 701. Furthermore, the display system 700 comprises a beam current measurement and control circuit 702 as described with reference to one of the FIGS. 3, 4, 5 or 6 for providing a beam current signal Vcnt1.

In operation, the video-processing circuit 701 performs a black current stabilization, color point stabilization, white level stabilization and beam current limiting in dependence upon a control voltage Vcnt1 corresponding to the measured beam current. The video-processing circuit 701 supplies a video signal to the cathode 205 of the cathode ray tube 100. Furthermore, the geometrical compensation circuit 703 is present to adjust the deflection of the beam across the display screen 170 in dependence upon the beam current signal Vcnt1.

What is claimed is:

1. A display device comprising a cathode ray tube including an electron source having a cathode for emission of electrons, an electron beam guidance cavity having an entrance aperture and an exit aperture for concentrating electrons emitted from the cathode in an electron beam, a first electrode arranged around the exit aperture and connectable to a first power supply to allow, in operation, electron transport to a display screen through the electron beam guidance cavity and the exit aperture, and modulating means positioned between the cathode and the exit aperture for modulating, in operation, the electron beam to the display screen, characterized in that the display device comprises switching means which are arranged to prevent the electron beam from passing through the exit aperture in a blanking period and to pass the electron beam to the display screen in a display period.

2. A display device as claimed in claim 1, characterized in that the switching means comprises a third electrode positioned between the first electrode and the modulating means in the cathode ray tube, the third electrode being connectable to a third power supply, the switching means including the first power supply and the third power supply.

3. A display device as claimed in claim 1, characterized in that the switching means comprises a third and a fourth electrode positioned between the first electrode and the modulating means, the third electrode being connectable to a third power supply and the fourth electrode being connectable to a fourth power supply, the switching means including the third and the fourth power supply.

4. A display device as claimed in claim 1, characterized in that, in operation, the modulating means comprises a second electrode which is connectable to a second power supply.

5. A display device as claimed in claim 4, characterized in that, in operation, a modulating voltage of the second power supply has a value in a first range for obtaining a diode characteristic of the modulating voltage versus beam current characteristics of the cathode ray tube.

6. A display device as claimed in claim 5, characterized in that, in operation, the second electrode is connected to a first current measurement means for measuring a current which is indicative of the beam current to the display screen.

7. A display device as claimed in claim 4, characterized in that, in operation, a modulating voltage of the second power supply has a value in a second range for obtaining a triode characteristic of the voltage versus beam current characteristics of the cathode ray tube.

8. A display device as claimed in claim 7, characterized in that, in operation, the cathode is connected to a second current measurement means for measuring the beam current of the cathode ray tube.

9. A display device as claimed in claim 1, characterized in that the exit aperture of the electron beam guidance cavity has a funnel shape.

10. A cathode ray tube for use in a display device as claimed in claim 1.

11. A display system comprising a display device as claimed in claim 1.

12. A display system as claimed in claim 11, characterized in that the display system comprises means for measuring the beam current.

13. A display system as claimed in claim 11, characterized in that current measurement means are connected to stabilization means for stabilizing the beam current, compensation means for geometrical compensation in dependence upon the strength of the beam current, and limiting means for limiting the beam current.

* * * * *